US011022401B1

(12) United States Patent
Lee

(10) Patent No.: US 11,022,401 B1
(45) Date of Patent: Jun. 1, 2021

(54) FIREARM GRIP

(71) Applicant: Shanyao Lee, Santa Ana, CA (US)

(72) Inventor: Shanyao Lee, Santa Ana, CA (US)

( * ) Notice: Subject to any disclaimer, the term of this patent is extended or adjusted under 35 U.S.C. 154(b) by 0 days.

(21) Appl. No.: 16/882,652

(22) Filed: May 25, 2020

(51) Int. Cl.
*F41C 23/16* (2006.01)

(52) U.S. Cl.
CPC ..... *F41C 23/16* (2013.01)

(58) Field of Classification Search
CPC ..... F41C 23/10; F41C 23/16; F41C 23/12; F41C 23/06
USPC ..... 42/71.02, 72, 94
See application file for complete search history.

(56) References Cited

U.S. PATENT DOCUMENTS 10,190,840 B1 * 1/2019 Renteria ..... F41A 23/02
2010/0031551 A1 * 2/2010 Griffin ..... F41C 23/16 42/72
2012/0167431 A1 * 7/2012 Rogers ..... F41C 23/16 42/72
2014/0068992 A1 * 3/2014 Keng ..... F41A 23/04 42/94
2015/0198408 A1 * 7/2015 Kincel ..... F41C 23/16 42/72
2016/0290760 A1 * 10/2016 Jen ..... F41C 23/16

* cited by examiner

*Primary Examiner* — Reginald S Tillman, Jr.
(74) *Attorney, Agent, or Firm* — Che-Yang Chen; Law Office of Michael Chen

(57) ABSTRACT

In one aspect, a firearm grip may include an elongated grip body that includes a front side, a rear side, and opposing sides. The grip body may further include a front notch, side notches and a rear notch. A flange is formed on each side of the grip body between the rear notch and side notches. The front notch may include a first front securing edge and a second front securing edge. Likewise, the rear notch may include a first rear securing edge and a second rear securing edge. In one embodiment, the first front securing edge of the front notch and the first rear securing edge of the rear notch are configured to lean against the uneven surface, such as the edge of the desk to stabilize the firearm.

9 Claims, 7 Drawing Sheets

FIREARM GRIP

FIELD OF THE INVENTION

The present invention relates to a firearm grip, and more particularly relates to a firearm grip for stabilizing the firearm when shooting.

BACKGROUND OF THE INVENTION

Hand grips for firearms such as handguns and long rifles are well known in the prior art. Such hand grips are often formed of materials that are easy to grip to allow the user to better grasp the firearm handle. Some of the materials used are also compressible. Hand grips also come in many different styles, shapes and designs.

For example, many anatomical hand grips or ergonomic hand grips have been developed to minimize or eliminate hand fatigue when the firearm is being held by a user. U.S. Pat. No. 7,243,454 to Cahill. discloses vertical fore grip for a firearm with an integrated pressure switch pocket. The vertical fore grip includes a body with internal storage cavity, a mount adapted to secure a firearm, a pocket for a pressure switch on the perimeter of the body, and a cap to secure a pressure switch and waterproof the internal storage cavity. The mount has a groove for a firearm rail, at least one locking bar, and a spring for engaging the locking bar to a firearm rail.

Also, U.S. Pat. No. 7,191,557 to Gablowski discloses grip that includes an exterior grip defining an inner bore; a slider located within the bore for axial movement relative to the exterior grip, the slider having a projection to selectively detachably engage the at least one transverse slot of the rail; and a screw rotatably mounted within the exterior grip. The screw threadingly engages the slider to axially move the slider into and/or out of engagement with the rail, but the screw is substantially secured against axial movement relative to the exterior grip.

Recently, U.S. Pat. No. 7,578,089 to Griffin discloses a weapon grip assembly for attachment to a forward portion of a weapon that includes a base assembly supported for operative engagement by a handle. The base assembly includes clamps adapted to be secured to a forward portion of the weapon and further includes a post having a clamp end adapted to retain the clamps for pivot motion with respect thereto. The post of the base assembly is received within a bore of the handle, a mandrel being interposed between the handle and the clamps of the base assembly. As the base assembly is drawn into the handle, by rotation of the handle about the post of the base assembly, the mandrel receives the clamp end of the post, with an upper free surface thereof engaging the clamps for pivoted closure about a portion of the weapon in furtherance of securing the weapon grip assembly thereto.

However, none of the firearm grips or hand grips discussed above focuses on the firearm grip configured to stabilize the firearm on an uneven surface when shooting. Therefore, there remains a need for a new and improved firearm grip to better stabilize the firearm on an uneven surface when shooting.

SUMMARY OF THE INVENTION

In one aspect, a firearm grip may include an elongated grip body that includes a front side, a rear side and opposing sides. In one embodiment, the firearm grip is preferably constructed from a lightweight, durable polymer that can withstand the rigors of combat and normal use. Alternatively, the firearm grip can also be constructed from various metals, composites, natural materials (such as wood and ivory), and/or a combination thereof.

The grip body is preferably angled and contoured to conform to the natural grip and position of a user's hand. Alternatively, the angle of the firearm grip can be fixed or adjustable to allow the user to fire from non-standard positions, which includes such orientations as from a vertical grip, a grip with a forward sweep, a curved grip, or a grip that is canted to the left or right.

In an exemplary embodiment, the elongated grip body may further include a front notch, side notches and a rear notch. A flange is formed on each side of the grip body between the side notch and rear notch. In one embodiment, the front notch may include a first front securing edge and a second front securing edge. More specifically, the first front securing edge can be formed from a midpoint of the front notch to a starting point of the side notch on one side, while the second front securing edge can be formed from the midpoint to the other starting point of the side notch on the other side.

Likewise, the rear notch may include a first rear securing edge and a second rear securing edge. More specifically, the rear front securing edge can be formed from a midpoint of the rear notch to an end point of one of the side notch, while the second rear securing edge can be formed from the midpoint to the end point of the other side notch.

When the firearm is being secured on an uneven surface such as an edge of a desk with the firearm grip in the present invention, the firearm along with the firearm grip is tilted and stabilized with a predetermined angle through the front notch and the rear notch of the firearm grip. In one embodiment, the firearm can be stabilized on the uneven surface through the front notch. More specifically, the first front securing edge and the second front securing edge of the front notch are configured to lean against the uneven surface, such as the edge of the desk, to stabilize the firearm. It is noted that when the firearm is stabilized at this angle, the side notches and the rear notch may not in contact with the uneven surface.

In another embodiment, the firearm along with the firearm grip in the present invention can be tilted with a different angle through the front notch and the rear notch. More specifically, the first and second front securing edges and the first and second rear securing edges are configured to lean against the uneven surfaces to provide support to stabilize the firearm. It is noted that the flange on one side may also be in contact with the uneven surface to provide support to stabilize the firearm.

In a further embodiment, the firearm can be stabilized through the side notches when the corner of the uneven surface is substantially perpendicular, and the firearm with the side notches can be used to lean against the corner to stabilize the firearm. It is noted that the firearm may still be stabilized with only one side of the side notches at the corner.

The present invention is advantageous because with at least of the front notch, side notches and rear notch of the firearm grip in the present invention, the firearm can be stabilized on an uneven surface through multiple securing edges on the firearm grip. More importantly, the firearm can be stabilized with different angles on the uneven surface when different securing edges are in contact with the uneven surface to provide support to stabilize the firearm.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
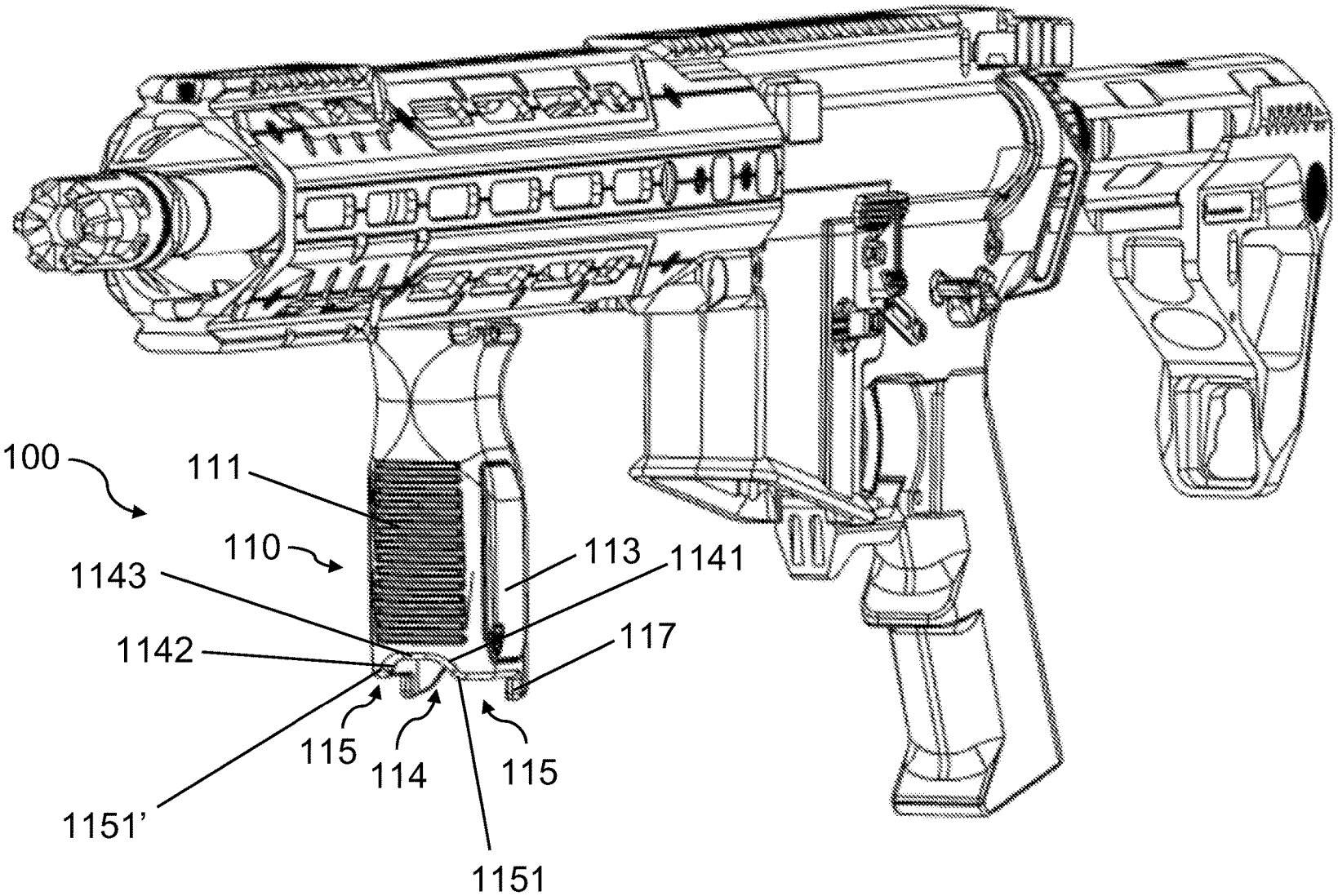
FIG. 1 is a schematic view of the firearm grip in the present invention.
Figure 2:
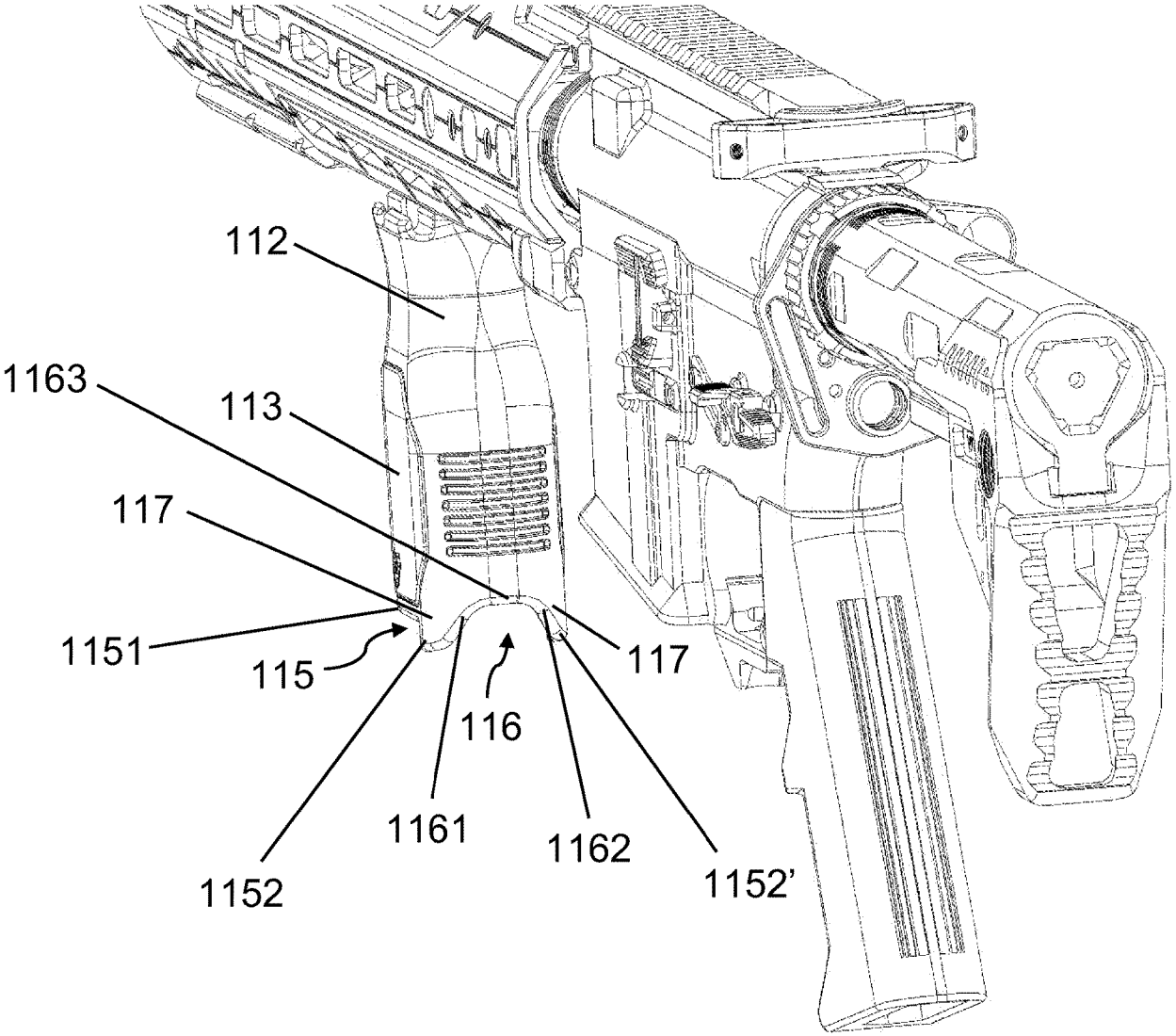
FIG. 2 is a schematic view from another angle of the firearm grip in the present invention.
Figure 3:
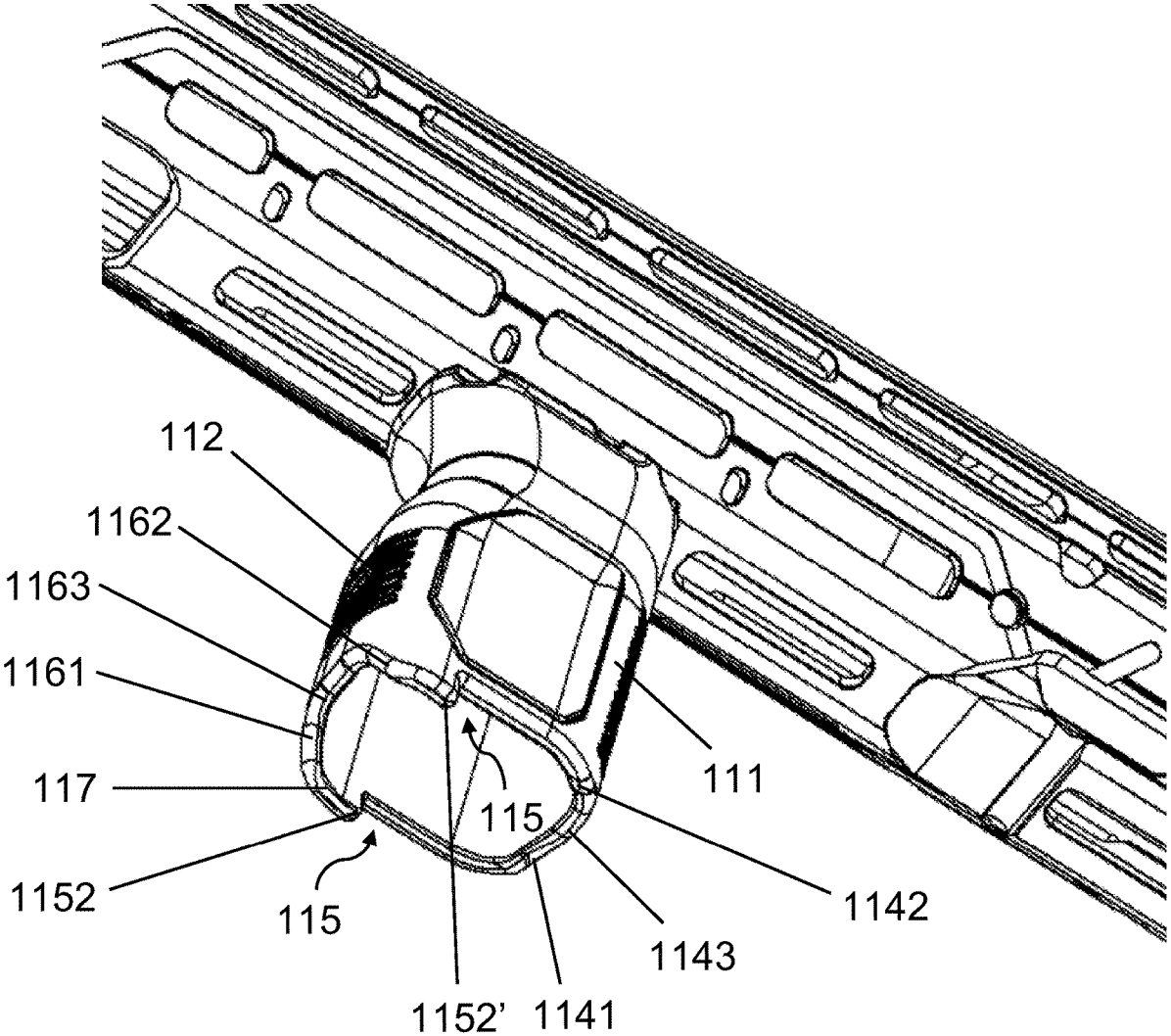
FIG. 3 is a schematic view from a different angle of the firearm grip in the present invention.

In one aspect, referring to FIGS. 1 to 3, a firearm grip 100 may include an elongated grip body 110 that includes a front side 111, a rear side 112, and opposing sides 113. In one embodiment, the firearm grip 100 is preferably constructed from a lightweight, durable polymer that can withstand the rigors of combat and normal use. Alternatively, the firearm grip 100 can also be constructed from various metals, composites, natural materials (such as wood and ivory), and/or a combination thereof.

The grip body 110 is preferably angled and contoured to conform to the natural grip and position of a user's hand. Alternatively, the angle of the firearm grip 100 can be fixed or adjustable to allow the user to fire from non-standard positions, which includes such orientations as from a vertical grip, a grip with a forward sweep, a curved grip, or a grip that is canted to the left or right.

In an exemplary embodiment, as shown in FIGS. 1 to 3, the elongated grip body 110 may further include a front notch 114, side notches 115 and a rear notch 116. A flange 117 is formed on each side of the grip body 110 between the side notch 115 and rear notch 116. In one embodiment, the front notch 114 may include a first front securing edge 1141 and a second front securing edge 1142. More specifically, the first front securing edge 1141 can be formed from a midpoint 1143 of the front notch 114 to a starting point 1151 of the side notch 115 on one side, while the second front securing edge 1142 can be formed from the midpoint 1143 to the other starting point 1151' of the side notch 115 on the other side.

Likewise, the rear notch 116 may include a first rear securing edge 1161 and a second rear securing edge 1162. More specifically, the rear front securing edge 1161 can be formed from a midpoint 1163 of the rear notch 116 to an end point 1152 of one of the side notch 115, while the second rear securing edge 1162 can be formed from the midpoint 1163 to the end point 1152' of the other side notch 115.

Figure 4:
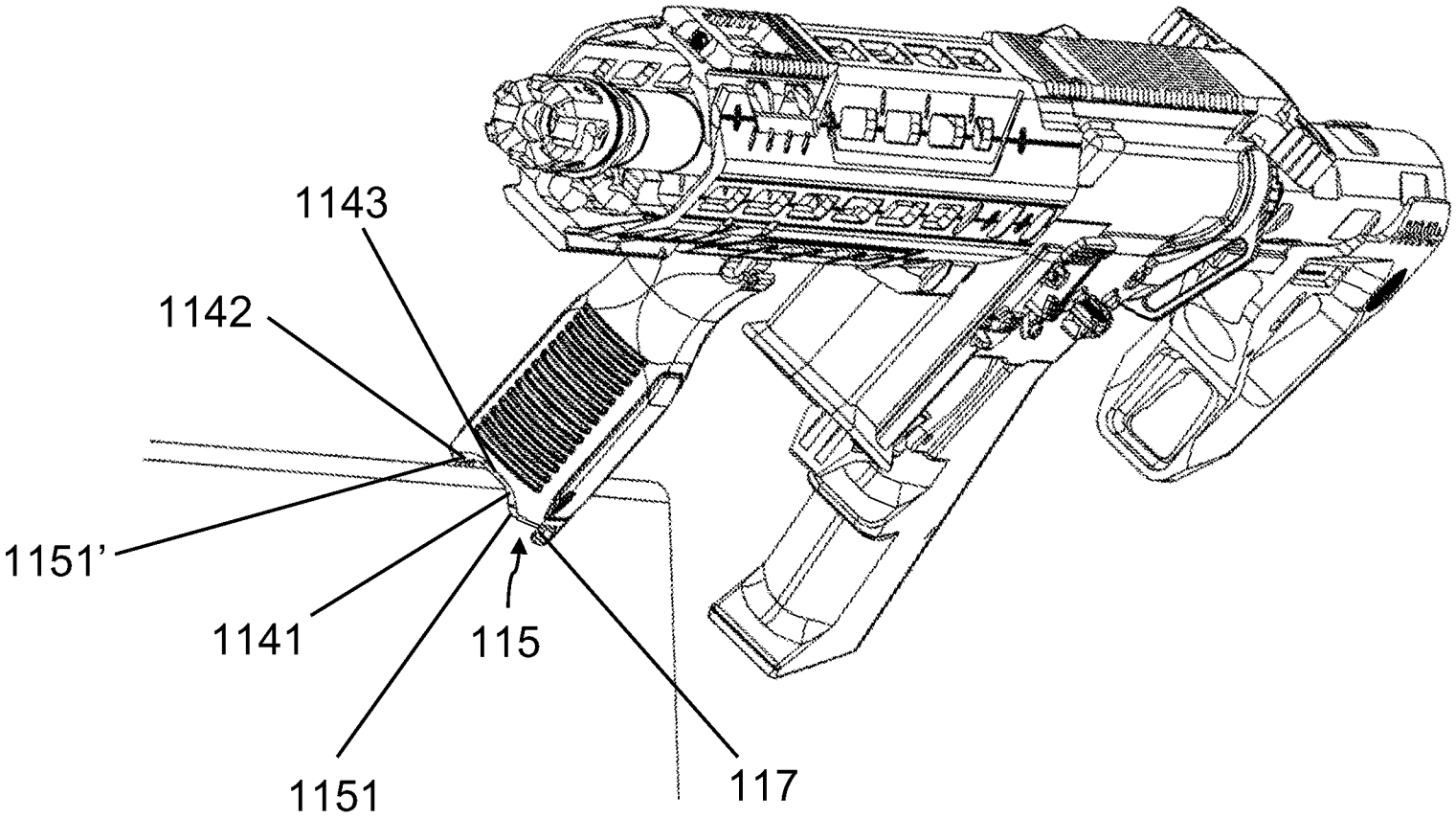
FIG. 4 is a schematic view from a front end of the firearm grip in the present invention when the firearm along with the firearm grip is stabilized on an uneven surface at a predetermined angle.
Figure 5A:
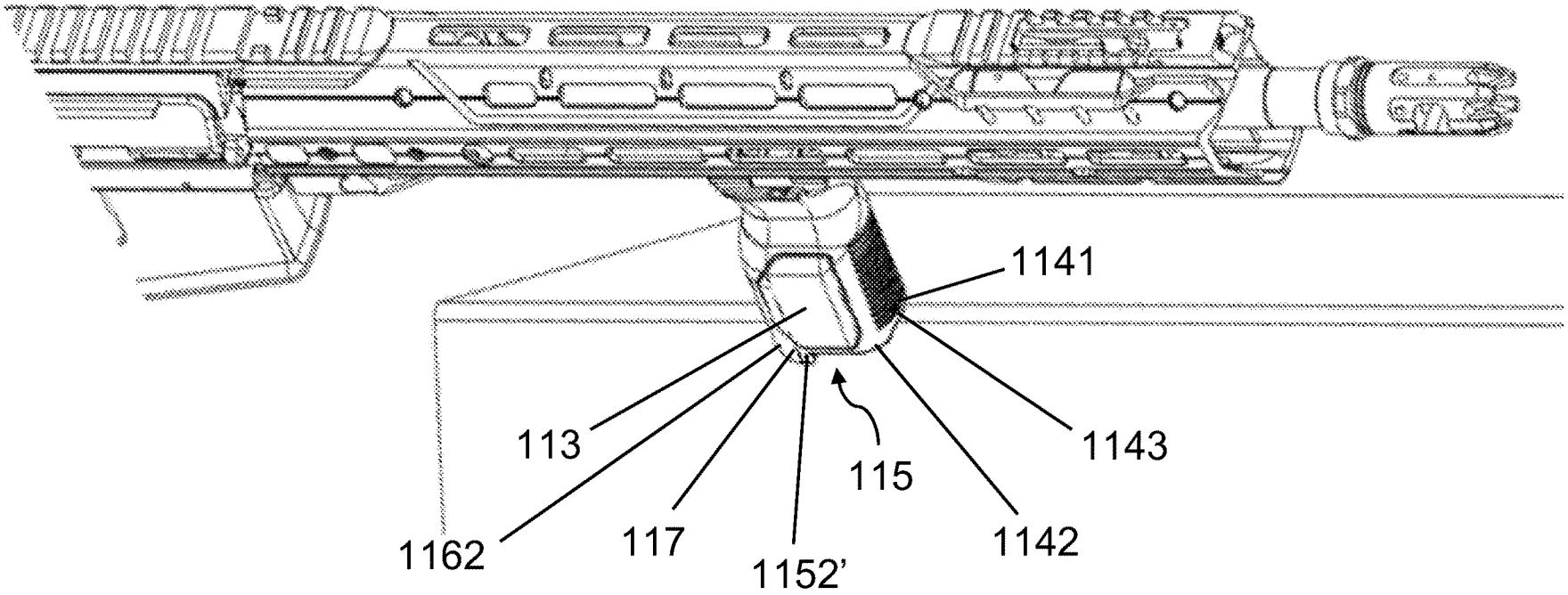
FIGS. 5*a* and 5*b* illustrate a schematic view of the firearm along with the firearm grip in the present invention to be stabilized on an uneven surface at a different angle.
Figure 5B:
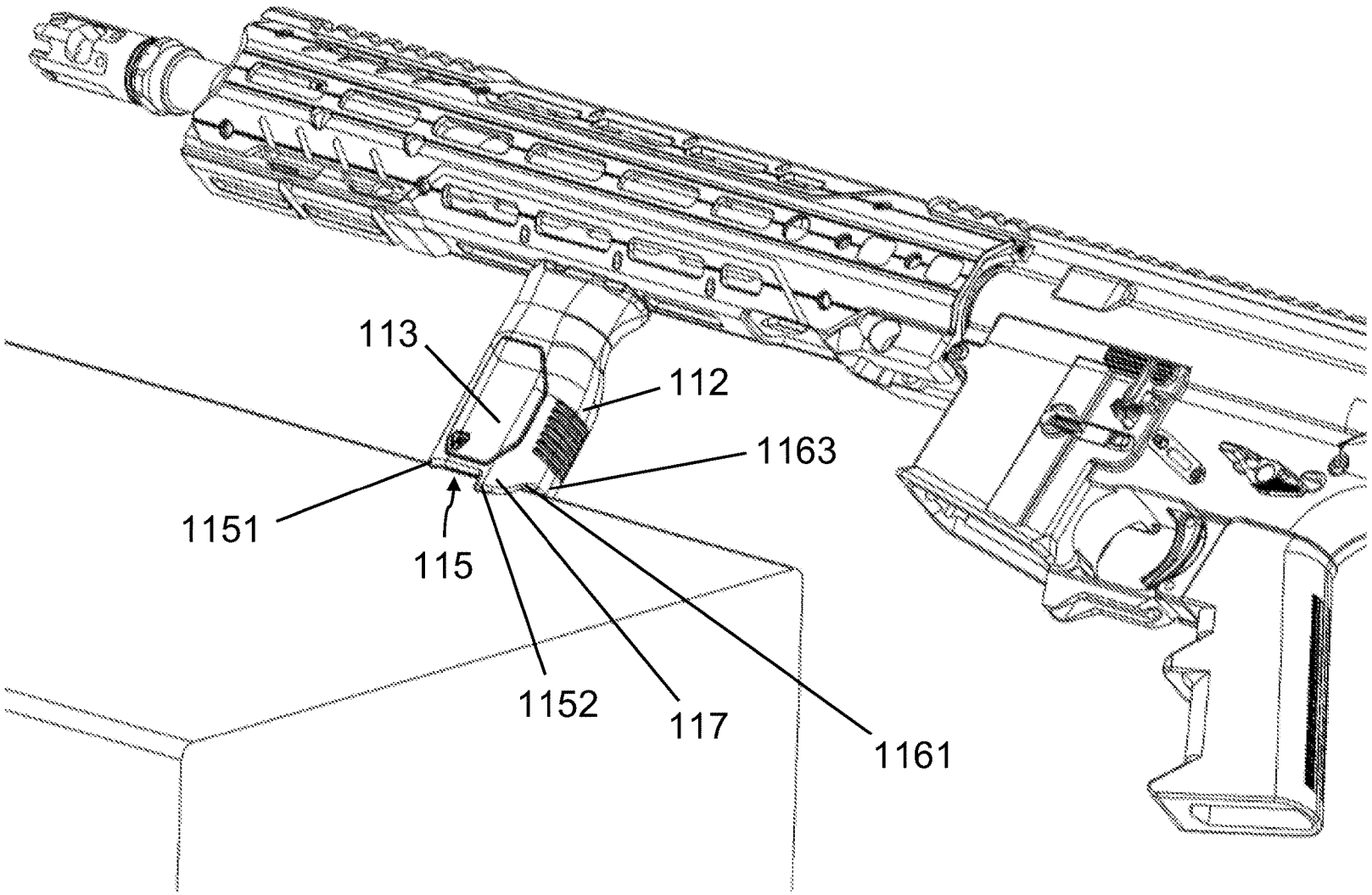

When the firearm is being secured on an uneven surface such as an edge of a desk with the firearm grip 100 in the present invention, the firearm along with the firearm grip 100 is tilted and stabilized with a predetermined angle through the front notch 114 and the rear notch 116 of the firearm grip 100 as shown in FIGS. 4, 5*a* and 5*b*. In one embodiment, as shown in FIG. 4, the firearm can be stabilized on the uneven surface through the front notch 114. More specifically, the first front securing edge 1141 and the second front securing edge 1142 of the front notch 114 are configured to lean against the uneven surface, such as the edge of the desk, to stabilize the firearm. It is noted that when the firearm is stabilized at this angle, the side notches 115 and the rear notch 116 may not in contact with the uneven surface.

In another embodiment, the firearm along with the firearm grip 100 in the present invention can be tilted with a different angle. As shown in FIGS. 5*a* and 5*b*, the firearm can be stabilized at this angle through the notch 114 and the rear notch 116. More specifically, the first and second front securing edges (1141, 1142) and the first and second rear securing edges (1161, 1162) are configured to lean against the uneven surfaces to provide support to stabilize the firearm. It is noted that as shown in FIG. 5*a*, the flange 117 on one side may also be in contact with the uneven surface to provide support to stabilize the firearm.

Figure 6:
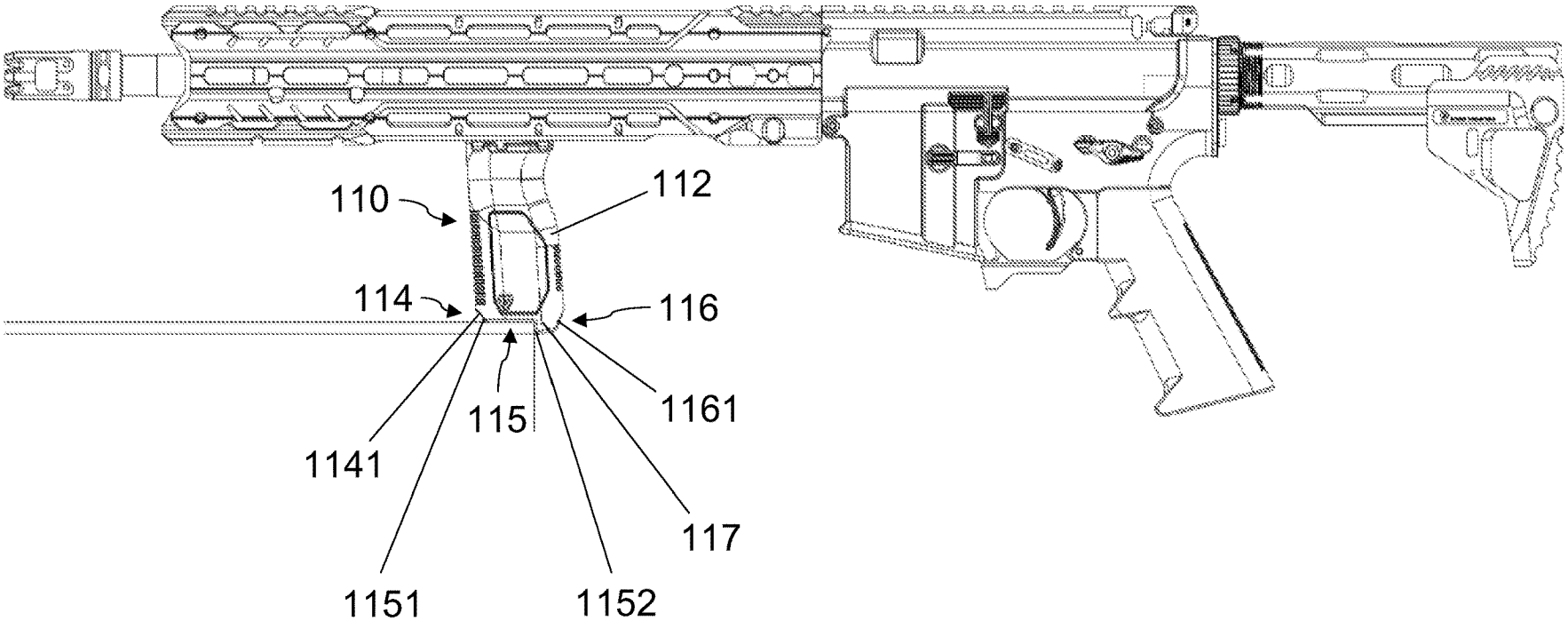
FIG. 6 illustrates a schematic view of the firearm along with the firearm grip in the present invention to be stabilized on an uneven surface at still a different angle.

In a further embodiment, the firearm can be stabilized through the side notches 115. As shown in FIG. 6, the corner of the uneven surface is substantially perpendicular and the firearm with the side notches 115 can be used to lean against the corner to stabilize the firearm. It is noted that the firearm may still be stabilized with only one side of the side notches 115 at the corner as shown in FIG. 6.

The present invention is advantageous because with at least of the front notch 114, side notches 115 and rear notch 116 of the firearm grip 100 in the present invention, the firearm can be stabilized on an uneven surface through multiple securing edges on the firearm grip 100. More importantly, the firearm can be stabilized with different angles on the uneven surface when different securing edges are in contact with the uneven surface to provide support to stabilize the firearm.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A firearm grip comprising an elongated grip body that includes a front side, a rear side and opposing sides; said elongated grip body including a front notch, side notches, and a rear notch; and a firearm with the firearm grip can be stabilized on an uneven surface at a predetermined angle when at least one of the front notch, side notches and rear notch is used to lean against the uneven surface, wherein the front notch includes a first front securing edge and a second front securing edge, and the rear notch includes a first rear securing edge and a second rear securing edge, and wherein the first front securing edge is formed from a midpoint of the front notch to a starting point of the side notch on one side, while the second front securing edge is formed from the midpoint to the other starting point of the side notch on the other side.

2. The firearm grip of claim 1, wherein the firearm grip further includes a flange formed on each side of the grip body between the side notch and rear notch to provide support to stabilize the firearm.

3. The firearm grip of claim 1, wherein the first rear securing edge is formed from a midpoint of the rear notch to an end point of the side notch on one side, while the second rear securing edge is formed from the midpoint to the other end point of the side notch on the other side.

4. The firearm grip of claim 1, wherein the firearm along with the firearm grip can be stabilized on the uneven surface at a predetermined angle when the front notch is configured to lean against the uneven surface through the first front securing edge and a second front securing edge.

5. The firearm grip of claim 1, wherein the firearm along with the firearm grip can be stabilized on the uneven surface at a different predetermined angle when the rear notch is configured to lean against the uneven surface through the first rear securing edge and a second rear securing edge.

6. The firearm grip of claim 1, wherein the firearm along with the firearm grip can be stabilized on the uneven surface at a different predetermined angle when the front and rear notches are configured to lean against the uneven surface through the first front securing edge, the second front securing edge, the first rear securing edge, and the second rear securing edge.

7. The firearm grip of claim 1, wherein at least one side notch is configured to lean against the uneven surface that is substantially perpendicular to said at least one side notch to stabilize the firearm with the firearm grip.

8. The firearm grip of claim 1, wherein the firearm grip preferably constructed from a lightweight, durable polymer that can withstand the rigors of combat and normal use.

9. The firearm grip of claim 1, wherein the firearm grip is constructed from various metals, composites, natural materials including wood and ivory, and/or a combination thereof.

* * * * *